United States Patent [19]

Cima

[11] Patent Number: 4,890,668

[45] Date of Patent: Jan. 2, 1990

[54] WICK ASSEMBLY FOR SELF-REGULATED FLUID MANAGEMENT IN A PUMPED TWO-PHASE HEAT TRANSFER SYSTEM

[75] Inventor: Richard M. Cima, Palo Alto, Calif.

[73] Assignee: Lockheed Missiles & Space Company, Inc., Sunnyvale, Calif.

[21] Appl. No.: 267,869

[22] Filed: Nov. 7, 1988

Related U.S. Application Data

[62] Division of Ser. No. 56,845, Jun. 3, 1987.

[51] Int. Cl.[4] ..... F28D 15/02

[52] U.S. Cl. ..... 165/104.25; 165/41; 165/104.26; 165/110

[58] Field of Search ..... 165/104.26, 104.25, 165/110, 907, 913, 41; 122/366

[56] References Cited

U.S. PATENT DOCUMENTS

| | | | |
|---|---|---|---|
| 3,892,273 | 7/1975 | Nelson | 165/104.26 |
| 4,019,571 | 4/1977 | Kosson et al. | 165/104.26 |
| 4,492,266 | 1/1985 | Bizzell et al. | 165/104.25 |

*Primary Examiner*—Albert W. Davis, Jr.
*Attorney, Agent, or Firm*—John J. Morrissey

[57] ABSTRACT

A two-phase closed-loop heat transfer system comprises a capillary-type evaporator 10, a condenser 11 (preferably also of the capillary type), and a vapor conduit 17 through which heat-laden working fluid in vapor phase is driven adiabatically from the evaporator 10 to the condenser 11. The evaporator 10 comprises a plurality of tubes 12 connected in parallel. A helically threaded capillary channel 39 is formed on the cylindrical interior surface of each tube 12, and a wick assembly 33 is positioned longitudinally within each tube 12. Each wick assembly 33 comprises a high-permeability wick 36 within which are embedded a first tubule 34 and a second tubule 35. The first and second tubules 34 and 35 are of low permeability, and have one closed end and one open end. The open end of the first tubule 34 is connected to a feed line 16 through which liquid-phase working fluid is delivered into the first tubule 34. Liquid-phase working fluid seeps through the first tubule 34 into the surrounding wick 36, and migrates through the wick 36 to the capillary channel 39 with which the wick 36 is in contact. Liquid-phase working fluid in excess of an amount needed to keep the capillary channel 39 wetted seeps from the wick 36 into the interior of the second tubule 35. The open end of the second tubule 35 is connected to a return line 18.

5 Claims, 11 Drawing Sheets

WICK ASSEMBLY FOR SELF-REGULATED FLUID MANAGEMENT IN A PUMPED TWO-PHASE HEAT TRANSFER SYSTEM

This application is a division of Ser. No. 56,845 filed June 3, 1987.

TECHNICAL FIELD

This invention relates generally to closed-loop heat transfer systems, and more particularly to a technique for achieving precise phase control over a working fluid circulating through a pumped two-phase closed-loop heat transfer system.

BACKGROUND OF THE INVENTION

In closed-loop heat transfer systems known to the prior art, capillary pumping techniques have been used to supply liquid-phase working fluid to heat-exchange surfaces for evaporation thereon to vapor phase. For example, in U.S. Pat. No. 4,470,450, a closed-loop heat transfer system was described, which comprises a capillary-type evaporator wherein a working fluid in liquid phase absorbs heat and is thereby evaporated to vapor phase, a condenser (preferably also of the capillary type) to which heat-laden working fluid in vapor phase is transported for condensation back to liquid phase, and a pump for returning the condensed working fluid in liquid phase from the condenser to the evaporator. However, until the present invention, two-phase circulation of a working fluid through a closed-loop heat transfer system having a capillary-type evaporator could not be precisely controlled so that liquid-phase working fluid is continuously supplied to each portion of the heat-exchange surface of the evaporator in exactly the amount needed to achieve optimally efficient heat exchange.

SUMMARY OF THE INVENTION

It is an object of the present invention to provide a self-regulating technique for managing two-phase circulation of a working fluid through a pumped closed-loop heat transfer system having an evaporator with a capillary-type heat-exchange surface, whereby working fluid in liquid phase is continuously supplied to all portions of the heat-exchange surface in the precise amount needed to meet changing requirements of a temporally and/or spatially varying heat load.

A pumped closed-loop heat transfer system according to the present invention comprises a capillary-type evaporator and a condenser (preferably also of the capillary type), which are connected by a vapor conduit through which heat-laden working fluid in vapor phase is driven substantially adiabatically from the evaporator to the condenser. A control valve is provided in the vapor conduit for regulating upstream vapor pressure (i.e., back pressure) in the evaporator so as to decouple pressure fluctuations in the condenser from the vapor pressure maintained in the evaporator. Thermodynamic conditions in the condenser can thereby vary with changes in environmental conditions to which the condenser is exposed without affecting temperature in the evaporator.

In a preferred embodiment of a heat transfer system according to the present invention, the evaporator comprises a plurality of hollow cylindrical evaporator tubes. Each evaporator tube has a capillary means on the cylindrical interior surface thereof for distributing liquid-phase working fluid over the interior surface of the tube. The capillary means is preferably a helically threaded capillary channel. Alternatively, the capillary means could be a series of elongate capillary channels extending longitudinally along the interior surface of the tube, or a layer of porous material deposited on the interior surface of the tube, or a capillary screen lining the interior surface of the tube. The evaporator tubes are all connected in parallel to a feed manifold, which is connected to a feed line. Working fluid is pumped in liquid phase via the feed line into the feed manifold for delivery therefrom to each of the evaporator tubes. The flow rate at which liquid-phase working fluid is delivered into the evaporator tubes is greater than needed to supply sufficient liquid-phase working fluid to meet the expected heat load of the evaporator.

The evaporator tubes are also all connected in parallel to a return manifold, which is connected to a return line. Liquid-phase working fluid in excess of the amount needed to meet the actual heat load of any individual evaporator tube is sucked out of the tube through the return manifold into the return line. The return line communicates with the feed line so as to by-pass the condenser. A control valve is provided in the return line to regulate the rate of flow of liquid-phase working fluid into the feed manifold.

The evaporator tubes are also connected in parallel to a vapor exit manifold, which is connected to a first end (i.e., an upstream end) of the vapor conduit. Working fluid that is converted to vapor phase at the heat-exchange surfaces of the evaporator tubes is driven substantially adiabatically from the evaporator tubes via the vapor exit manifold into the vapor conduit for passage to the condenser. It is a feature of the present invention that the evaporator be of the capillary type, i.e., that a capillary channel (or channels) be formed on the heat-exchange surface (or surfaces) of the evaporator. However, there is no requirement that the condenser be of the capillary type. Nevertheless, in a preferred embodiment of the invention, the condenser likewise comprises a plurality of hollow cylindrical tubes connected in parallel to a vapor entrance manifold, which is connected to a second end (i.e., a downstream end) of the vapor conduit. Heat-laden working fluid in vapor phase leaving the evaporator tubes through the vapor exit manifold passes via the vapor conduit into the vapor entrance manifold, which is connected to the condenser tubes.

In the condenser, the heat load of the vapor-phase working fluid is rejected to a heat sink, and the vapor-phase working fluid is thereby condensed to liquid phase. The condenser tubes of the preferred embodiment of the invention are also connected in parallel to a condensate exit manifold, which is connected to a condensate line. Condensed working fluid is sucked out of the condenser tubes via the condensate exit manifold into the condensate line, which merges with the return line to form a coadunate conduit wherein liquid-phase working fluid from the return line mixes with liquid-phase working fluid from the condensate line.

In the preferred embodiment of the invention, a single mechanical pump provides a sufficient suction pressure to suck excess liquid-phase working fluid out of the evaporator tubes, and condensed working fluid out of the condenser tubes, into the coadunate conduit. A subcooler is provided in the coadunate conduit upstream of the pump inlet, so that any vapor-phase working fluid that might have been sucked from the evaporator tubes into the return line is converted to liquid phase before being pumped via the feed line and the feed manifold back to the evaporator tubes. Subcooling of the liquid-phase working fluid upstream of the pump inlet provides a net positive suction pressure at the pump inlet, which prevents cavitation in the pump. A control valve is disposed in the coadunate conduit between the subcooler and the pump inlet to regulate the volume of liquid-phase working fluid entering the pump. A sufficient pressure is provided at the pump outlet to drive the subcooled liquid-phase working fluid through the feed line to the feed manifold for delivery to the evaporator tubes at the required flow rate. An accumulator is provided in the feed line downstream of the pump outlet in order to store a sufficient inventory of liquid-phase working fluid to accommodate changes that might occur anywhere in the system in the density of the liquid-phase working fluid. A control valve in the feed line regulates the flow rate of liquid-phase working fluid into the feed manifold.

It is a feature of a heat transfer system according to the present invention that working fluid passes through the evaporator, out of the evaporator into the condenser, and through the condenser, in a completely passive manner. No active components are needed for regulating the supply of liquid-phase working fluid within the evaporator to the heat-exchange surfaces thereof, or for regulating the removal of heat-laden working fluid in vapor phase from the evaporator to the condenser, or for regulating the removal within the condenser of working fluid in liquid phase from the heat-exchange surfaces thereof.

With reference to the preferred embodiment of the present invention, heat exchange takes place in the evaporator as liquid-phase working fluid absorbs heat (and is thereby converted to vapor phase) in the helical capillary channel on the interior surface of each evaporator tube. In an alternative embodiment of the present invention, the evaporator could be a chamber having at least one planar (preferably rectangular) interior wall that serves as a heat-exchange surface, in which case a plurality of linear capillary channels would be formed (preferably parallel to one another and immediately adjacent each other) on the heat-exchange surface. In order for heat exchange in the evaporator to occur at maximum efficiency, the capillary channels (i.e., the helical channels in the corresponding evaporator tubes, or the linear channels on the planar heat-exchange surface) must be continuously supplied with sufficient liquid-phase working fluid so that all portions of each capillary channel remain wetted with liquid-phase working fluid for evaporation to vapor phase as heat is being absorbed, regardless of temporal and/or spatial variations in the heat load applied to the evaporator. Regardless of the configuration of the evaporator, each capillary channel (whether helical, linear, or of some other configuration) preferably has a V-shaped transverse cross section.

In order for all portions of the helical capillary channel on the heat-exchange surface of each evaporator tube of an evaporator according to the preferred embodiment of the present invention to remain wetted with liquid-phase working fluid as evaporation occurs, an elongate wick assembly is positioned in each evaporator tube in contact with ridges defining a portion of the helical capillary channel. The wick assembly receives liquid-phase working fluid from the feed manifold at a flow rate adequate to assure that sufficient liquid-phase working fluid is always available in the wick assembly to keep the capillary channel wetted. The V-shaped transverse cross section of the capillary channel ensures that liquid-phase working fluid available in the wick assembly is drawn into the capillary channel as needed to keep the capillary channel continuously wetted.

When a wetting liquid is contained within a V-shaped channel (i.e., a channel of V-shaped transverse cross section), a meniscus is formed at the surface of the liquid. In general, the radius of curvature of the meniscus decreases monotonically as the level of the wetting liquid in the V-shaped channel decreases. In the case of a V-shaped capillary channel on the heat-exchange surface of an evaporator tube according to the preferred embodiment of the present invention, the capillary pressure head drawing liquid-phase working fluid from the wick assembly into the capillary channel is inversely proportional to the radius of curvature of the meniscus. Thus, when the rate of evaporation of liquid-phase working fluid from the capillary channel increases at a particular time and/or at a particular place along the capillary channel due to a temporal and/or a spatial increase in the heat load applied to the evaporator tube at that time and/or place, the level of liquid-phase working fluid in the capillary channel correspondingly decreases. The increase in the capillary pressure head associated with the decrease in the level of liquid-phase working fluid in the capillary channel concomitantly induces an increase in the rate of flow of liquid-phase working fluid from the wick assembly into the capillary channel, thereby keeping the capillary channel wetted with liquid-phase working fluid.

Each wick assembly of the present invention is a structure comprising a hollow first tubule having a porous cylindrical wall of relatively low permeability with respect to liquid-phase working fluid, and a hollow second tubule likewise having a porous cylindrical wall of relatively low permeability. Each of the first and second tubules is closed at one end, and both of the first and second tubules are embedded in an elongate wick of relatively high permeability with respect to liquid-phase working fluid. The first and second tubules extend substantially parallel to each other within the wick. Each wick assembly is positioned inside a corresponding evaporator tube so that the high-permeability wick is seated upon (and pressed into contact with) ridges defining the helically threaded capillary channel on the interior heat-exchange surface of the evaporator tube.

In each wick assembly, open ends of the first and second tubules extend out from a first end of the wick. The open end of the first tubule is connected to a corresponding branch of the feed manifold, and the open end of the second tubule is connected to a corresponding branch of the return manifold. The corresponding branches of the feed manifold and the return manifold penetrate a gas-tight closure plate at a first end of the evaporator tube, and extend into the interior thereof to make connection with the first tubule and the second tubule, respectively. Similarly, a corresponding branch of the vapor exit manifold penetrates a gas-tight closure plate at a second end of each evaporator tube, whereby all of the evaporator tubes communicate with the vapor exit manifold.

Liquid-phase working fluid is delivered from the feed manifold into the first tubule of each wick assembly at a relatively high pressure head. The diameter of the first tubule is dimensioned relative to its length so that the ratio of radial pressure drop (i.e., the pressure drop radially outward from the center to the wall of the first tubule) to axial pressure drop (i.e., the pressure drop longitudinally from the open end to the closed end of the first tubule) results in a substantially uniform rate of seepage of liquid-phase working fluid through the low-permeability wall of the first tubule all along its length into the surrounding high-permeability wick. Liquid-phase working fluid seeping out of the first tubule saturates the surrounding wick, and passes from the wick into the helical capillary channel with which the wick is in contact on the interior surface of the evaporator tube.

Liquid-phase working fluid introduced into the helical capillary channel from the saturated wick is then transported via the capillary channel by capillary action to all portions of the heat-exchange surface of each evaporator tube. Liquid-phase working fluid in excess of the amount needed to keep the capillary channel in each evaporator tube wetted seeps from the saturated wick into the second tubule through the low-permeability wall thereof. Excess liquid-phase working fluid is sucked by the pump at a relatively high pressure head from the second tubule of the wick assembly in each evaporator tube into the return manifold, and from the return manifold into the return line.

The relatively high pressure heads needed to pump liquid-phase working fluid into the evaporator tubes via the feed line, and to suck excess liquid-phase working fluid out of the evaporator tubes via the return line and to suck condensed working fluid out of the condenser tubes via the condensate line, are isolated by means of the first and second tubules from the relatively low capillary pressure heads that are developed in the high-permeability wick and in the capillary channels on the interior surfaces of the evaporator tubes. The high-permeability wick in each evaporator tube functions as a capillary communication bridge for liquid-phase working fluid passing from the first tubule into the wick, and from the wick into the second tubule.

The low-permeability wall of the second tubule enables liquid-phase working fluid to pass from the saturated wick into the second tubule, and to flow through the second tubule with a negligible radial pressure drop to the return manifold at a flow rate greater than the flow rate for liquid-phase working fluid in the first tubule. The pore size of the material from which the second tubule is made is small enough to withstand a bubble suction pressure that is greater than the suction pressure applied to the return line. For a given suction pressure in the return line, the rate of removal of excess liquid-phase working fluid from the wick into the second tubule can vary from a rate that is greater than the flow rate at which liquid-phase working fluid is delivered to the first tubule to a flow rate that is near-zero, depending upon the net evaporative heat load being handled by the evaporator tube at any given time. For most applications, the first and second tubules can be made from the same material and can have the same dimensions.

The suction pressure drawing excess liquid-phase working fluid from the saturated wick into the second tubule might be strong enough to draw a relatively small amount of vapor-phase working fluid from the interior of the evaporator tube into the second tubule. However, the preferred disposition of the second tubule within the wick assembly (i.e., in the immediate vicinity of and parallel to the first tubule) ensures that a significant fraction of any vapor-phase working fluid that might be drawn into the second tubule would condense to liquid phase before leaving the second tubule to enter the return manifold. Since liquid-phase working fluid pumped via the feed line and the feed manifold into the first tubule has been subcooled, and since the flow directions for liquid-phase working fluid in the first and second tubules are opposite each other, the first and second tubules in combination function as a counter-flow heat exchanger. A significant amount of heat is therefore removed from any vapor-phase working fluid in the second tubule by the subcooled liquid-phase working fluid flowing in the opposite direction in the first tubule.

In the preferred embodiment of the present invention, the condenser comprises a plurality of hollow cylindrical condenser tubes connected in parallel to a condensate manifold. A helically threaded capillary channel of V-shaped transverse cross section is provided on the cylindrical interior wall forming the heat-exchange surface of each condenser tube, and a corresponding elongate wick assembly is positioned in the interior of each corresponding condenser tube. Heat exchange, whereby vapor-phase working fluid is condensed to liquid phase, occurs in the capillary channel. The condenser wick assembly inside each condenser tube is positioned so as to be seated upon (and pressed into contact with) ridges defining a portion of the helically threaded capillary channel on the heat-exchange surface of the condenser tube.

A wick assembly for a condenser tube differs from a wick assembly for an evaporator tube of the present invention, particularly in that the wick assembly for the condenser tube comprises only a single closed-end tubule of relatively low permeability embedded in a high-permeability wick. However, with respect to dimensions and materials of construction, as well as with respect to the technique for securing the wick in contact with ridges defining a portion of the capillary channel on the interior surface of the condenser tube, the wick assembly for the condenser tube substantially resembles the wick assembly for the evaporator tube.

Vapor-phase working fluid from the vapor conduit, which enters via the vapor entrance manifold into each of the condenser tubes, gives up its heat load and is thereby condensed to liquid phase in the capillary channels on the interior heat-exchange surfaces of the condenser tubes. In each condenser tube, condensed working fluid collects in the capillary channel on the interior surface thereof, and is transported via the capillary channel to the high-permeability wick. As condensation continues, the wick eventually becomes saturated with liquid-phase working fluid, which seeps from the wick through the low-permeability porous walls of the condenser tubule into the interior thereof. The condensed liquid-phase working fluid is sucked out of the condenser tubules by the pump, and is drawn into the condensate manifold for passage to the condensate line. The condensate line merges with the return line, and liquid-phase working fluid from the condensate line mixes with liquid-phase working fluid from the return line in the coadunate conduit. The mixed liquid-phase working fluid is then drawn through the subcooler into the inlet of the pump for delivery via the feed line to the evaporator manifold.

Because a heat transfer system according to the present invention uses a mechanical pump, the distance from the evaporator to the condenser (i.e., the length of the vapor conduit) is limited only by the pumping pressures in the feed line, the return line and the condensate line. The length of the vapor conduit is not limited by capillary pressure heads at the heat-exchange surfaces of the evaporator and the condenser, which would be a limiting factor in determining the maximum practicable length of a conventional heat pipe. Applications for heat transfer systems according to the present invention are envisioned in which the distance from the evaporator to the condenser is on the order of hundreds of meters.

BEST MODE OF CARRYING OUT THE INVENTION

Figure 1:
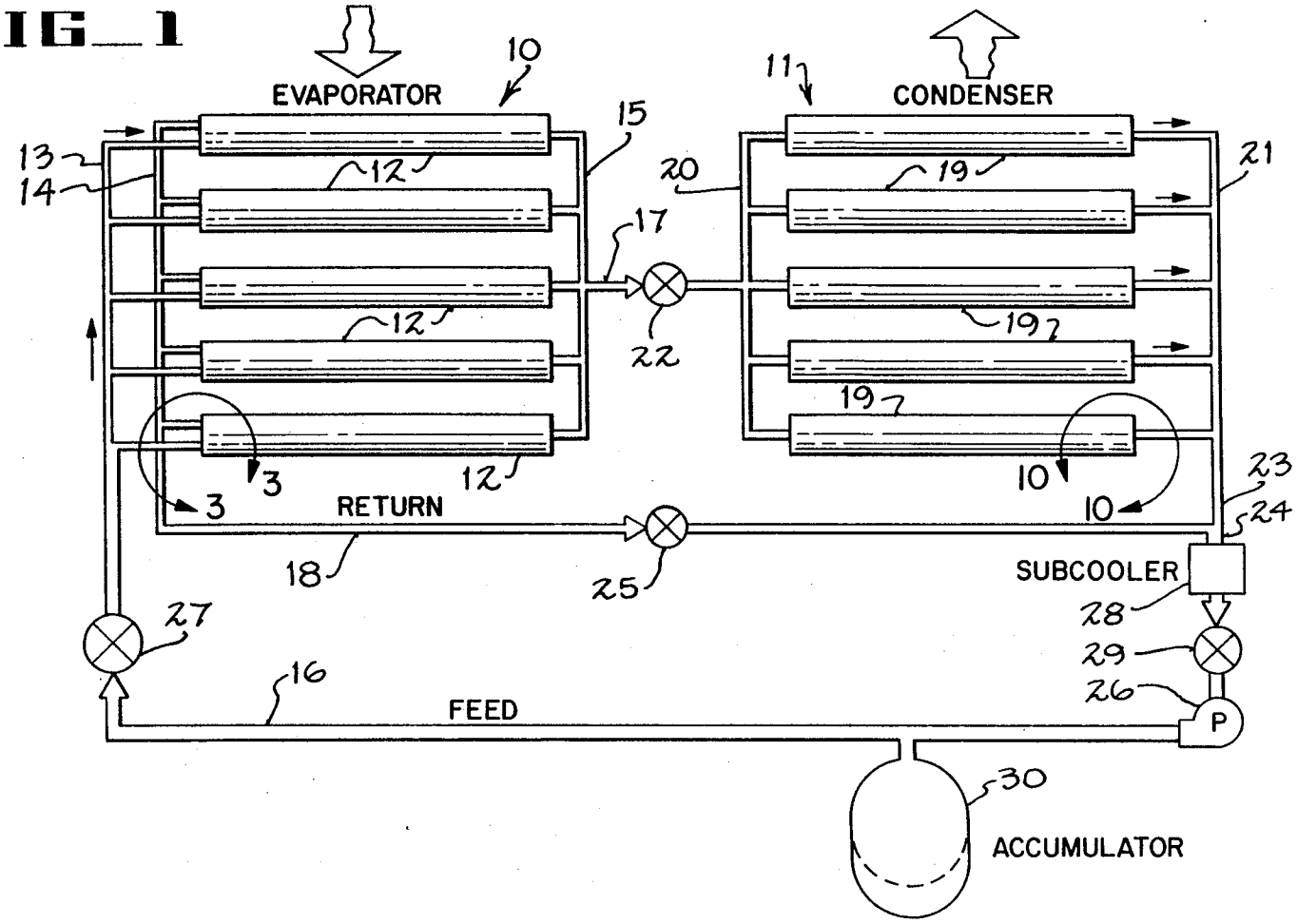
FIG. 1 is a schematic representation of a pumped two-phase closed-loop capillary-type heat transfer system according to the present invention.

A self-regulating closed-loop capillary-type heat transfer system according to the present invention, as illustrated schematically in FIG. 1, comprises an evaporator 10 (which is exposed to a heat source), a condenser 11 (which is exposed to a heat sink), and ducting and pumping means for circulating a working fluid from the evaporator 10 to the condenser 11 and back to the evaporator 10 in a two-phase closed-loop cycle.

In accordance with a preferred embodiment of the present invention, the evaporator 10 comprises a plurality of elongate hollow cylindrical evaporator tubes 12, which are connected in parallel to a feed manifold 13, to a return manifold 14 and to a vapor exit manifold 15. Each of the evaporator tubes 12 is closed at both ends by closure plates welded thereto. Corresponding branches of the feed manifold 13 and return manifold 14 are connected to a first end of each of the evaporator tubes 12, and a corresponding branch of the vapor exit manifold 15 is connected to a second end of each of the evaporator tubes 12. Relatively cold working fluid in liquid phase is delivered via a feed line 16 to the feed manifold 13, and passes from the feed manifold 13 into each of the evaporator tubes 12 at a flow rate in excess of the flow rate needed to meet the actual heat load of the evaporator 10.

Liquid-phase working fluid in the evaporator tubes 12 absorbs heat from the heat source to which the evaporator 10 is exposed, and is thereby converted to vapor phase. The heat-laden working fluid in vapor phase is driven substantially adiabatically from the evaporator tubes 12 into the vapor exit manifold 15. The vapor exit manifold 15 is coupled to a first end (i.e., an upstream end) of a vapor conduit 17 through which the vapor-phase working fluid passes to the condenser 11. Liquid-phase working fluid in excess of the amount required for evaporative heat absorption in the evaporator tubes 12 is withdrawn therefrom into the return manifold 14 for passage via a return line 18 to means (described hereinafter) for recirculating liquid-phase working fluid via the feed line 16 to the evaporator 10.

In the preferred embodiment, the condenser 11 comprises a plurality of elongate hollow cylindrical condenser tubes 19, which are connected in parallel to a vapor entrance manifold 20 and to a condensate exit manifold 21. Each of the condenser tubes 19 is closed at both ends by closure plates welded thereto. In the embodiment shown in FIG. 1, a corresponding branch of the vapor entrance manifold 20 is connected to a first end of each of the condenser tubes 19, and a corresponding branch of the condensate exit manifold 21 is connected to a second end of each of the condenser tubes 19. The vapor entrance manifold 20 is coupled to a second end (i.e, a downstream end) of the vapor conduit 17.

Since the evaporator 10 contains both saturated liquid-phase working fluid and vapor-phase working fluid, the temperature in the evaporator 10 can be controlled by adjusting the vapor pressure of the vapor-phase working fluid (i.e., the back pressure) therein. A vapor control valve 22 in the vapor conduit 17 maintains a substantially constant back pressure in the evaporator 10, and thereby maintains the temperature in the evaporator 10 at a predetermined constant value. In effect, the vapor control valve 22 decouples the pressure in the evaporator 10 from pressure fluctuations in the condenser 11, so that the temperature in the condenser 11 can vary with changes in environmental conditions to which the condenser 11 is exposed without affecting the temperature in the evaporator 10. In applications in which expected temperature fluctuations in the condenser 11 would be insignificant, the vapor control valve 22 could be eliminated.

Working fluid that condenses to liquid phase in the condenser tubes 19 is withdrawn therefrom via the condensate exit manifold 21 into a condensate line 23. The condensate line 23 merges with the return line 18 to form a coadunate conduit 24 in which excess liquid-phase working fluid from the return line 18 and condensed working fluid from the condensate line 23 are mixed. A control valve 25 in the return line 18 regulates the rate of flow of excess liquid-phase working fluid into the coadunate conduit 24.

A mechanical pump 26, whose inlet is connected to the coadunate conduit 24, and whose outlet is connected to the feed line 16, provides sufficient suction pressure to suck excess liquid-phase working fluid out of the evaporator tubes 12 via the return manifold 14 and the return line 18, and also to suck condensed working fluid out of the condenser tubes 19 via the condensate manifold 21 and the condensate line 23. The pump 26 also provides sufficient outlet pressure to drive the mixed liquid-phase working fluid from the coadunate conduit 24 through the feed line 16 into the feed manifold 13 for delivery to the individual evaporator tubes 12. A control valve 27 in the feed line 16 regulates the rate of flow of liquid-phase working fluid into the feed manifold 13, so that the amount of liquid-phase working fluid delivered into each evaporator tube 12 is always greater than needed to meet the expected heat load to be absorbed therein.

In the preferred embodiment, a subcooler 28 is provided in the coadunate conduit 24 upstream of the pump 26, so that substantially all vapor-phase working fluid tat might have been sucked out of the evaporator tubes 12 along with excess liquid-phase working fluid is converted to liquid phase before entering the pump 26. Subcooling of liquid-phase working fluid in the coadunate conduit 24 upstream of the pump 26 ensures a net positive suction pressure at the pump inlet, which precludes cavitation in the pump 26.

A control valve 29 could be provided in the coadunate conduit 24 between the subcooler 28 and the inlet of the pump 26 in order to regulate the rate of flow of subcooled liquid-phase working fluid into the pump 26. An accumulator 30 could be provided in the feed line 16 downstream of the pump 26 to store an inventory of "make-up" working fluid in liquid phase, so that changes in density of the liquid-phase working fluid that might occur in the system during operation would be accommodated.

Figure 2:
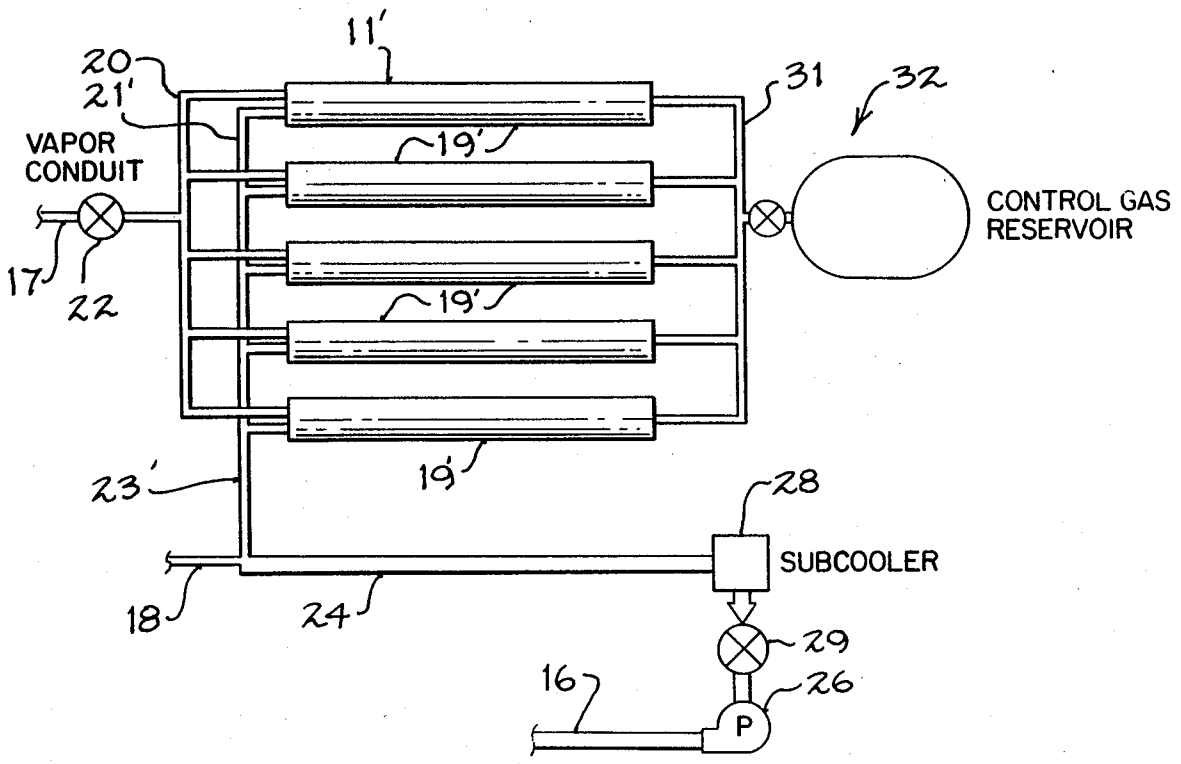
FIG. 2 is a schematic representation of an alternative embodiment of a condenser for the heat transfer system shown in FIG. 1.

In certain applications, it is desirable to be able to regulate the heat conductance of the condenser 11. Thus, in an alternative embodiment of the invention as illustrated in FIG. 2, the condenser 11 of FIG. 1 is replaced by a condenser 11' comprising a plurality of condenser tubes 19'. Corresponding branches of the vapor entrance manifold 20 and a condensate manifold 21' are connected to a first end of each of the condenser tubes 19', and a corresponding branch of a control gas manifold 31 is connected to a second end of each of the condenser tubes 19'. Liquid-phase working fluid withdrawn from the condenser tubes 19' into the condensate manifold 21' passes to a condensate line 23', which merges with the return line 18 to form the coadunate conduit 24. A control gas reservoir 32 communicates with the control gas manifold 31 to permit a measured amount of control gas at a predetermined pressure and temperature to be present in each of the condenser tubes 19' at any given time.

The control gas used for any particular application must be substantially noncondensible at the operating temperatures and pressures of the system. Ordinarily, for a typical control gas, the volume of the control gas reservoir 32 is much larger than the combined volumes of all the condenser tubes 19'. In operation, control gas accumulates at the second end of each condenser tube 19' (i.e., at the end connected to the control gas manifold 31), and condensible working fluid in vapor phase fills the remaining volume of each condenser tube 19'. The pressure of the control gas together with the partial pressure of vapor of the working fluid that becomes diffused in the control gas balance the pressure of the condensible vapor-phase working fluid present in the remaining volume of each condenser tube 19'. The volume of control gas in each condenser tube 19' in general varies inversely with the volume of condensible (but uncondensed) vapor-phase working fluid present therein, and is therefore self-adjusting according to the rate of condensation of the vapor-phase working fluid. The volume of control gas in each condenser tube 19' in effect determines the functional length thereof, and thereby determines the heat conductance of each condenser tube 19' for a given set of thermal conditions.

Figure 3:
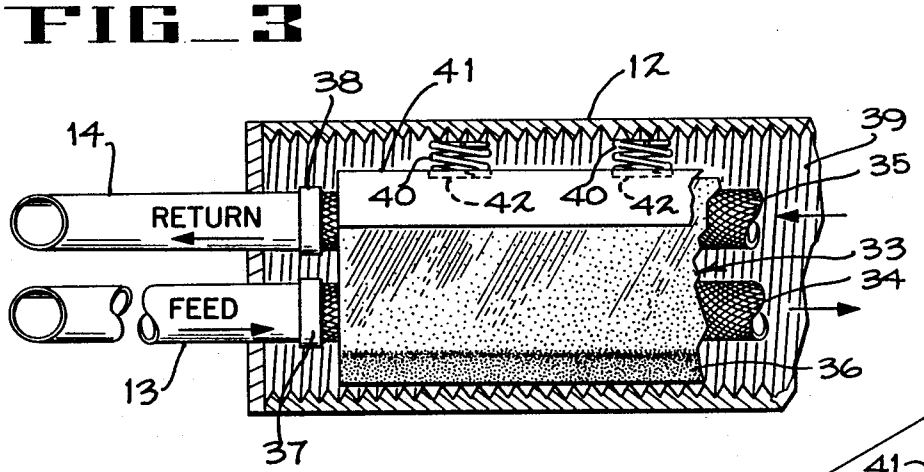
FIG. 3 is a cut-away view in longitudinal cross section of an end portion, as enclosed within arcuate line 3—3 of FIG. 1, of an evaporator tube of the heat transfer system of FIG. 1.

Positioned inside each of the evaporator tubes 12 is a wick assembly 33, as illustrated in FIG. 3. In the preferred embodiment, the wick assembly 33 comprises a first porous tubule 34 and a second porous tubule 35 (both of which are of relatively low permeability), and an elongate wick 36 (of relatively high permeability). The first and second tubules 34 and 35 are embedded in the wick 36, and extend parallel to each other with a spacing between each other that is smaller that the diameter of either of the tubules 34 and 35. Each of the tubules 34 and 35 is closed at one end. An open end of the first tubule 34 is connected by means of a coupling sleeve 37 to a corresponding branch of the feed manifold 13, and an open end of the second tubule 35 is connected by means of a coupling sleeve 38 to a corresponding branch of the return manifold 14.

A helically threaded capillary channel 39 having a V-shaped transverse cross section is formed on the cylindrical interior heat-exchange surface of each evaporator tube 12. The wick assembly 33 is positioned within the corresponding evaporator tube 12 so that the wick 36 is seated upon (and pressed into contact with) ridges on the interior surface of the evaporator tube 12 defining a portion of the threaded capillary channel 39.

In the embodiment of the wick assembly 33 shown in FIG. 3, contact between the wick 36 and ridges defining a portion of the capillary channel 39 is maintained by means of a plurality of helical springs 40, which bear against an elongate yoke 41 that arches over and extends along the length of the wick 36. As shown in perspective view in FIG. 4, an obverse side of the yoke 41 is concavely configured to engage a correspondingly convex surface portion of the wick 36, nd a reverse side of the yoke 41 is substantially flat with a plurality of circularly cylindrical depressions 42 positioned thereon. The depressions 42 are substantially collinear along the direction of elongation of the yoke 41, and are equally spaced from each other along the reverse surface thereof. Each depression 42 is dimensioned to receive one end of a corresponding one of the helical springs 40. The other end of each spring 40 bears against ridges defining a corresponding portion of the capillary channel 39 on a corresponding portion of the interior surface of the evaporator tube 12. The springs 40 are under compression, and therefore urge the yoke 41 (and the wick 36 in contact therewith) toward ridges defining another portion of the capillary channel 39 on a diametrically opposite portion of the interior surface of the evaporator tube 12. The effect of the springs 40 is to press a curved surface portion of the wick 36 into contact with ridges defining that other portion of the capillary channel 39 along substantially the entire length of the interior of the evaporator tube 12. It is noted that alternative techniques of a conventional nature are also available for pressing the wick 36 firmly into contact with ridges defining the capillary channel 39.

The working fluid used in a heat transfer system of the present invention is selected for each particular application in accordance with criteria whereby a general requirement that as much heat as possible be absorbed from the heat source per unit mass of working fluid is balanced against various particular requirements, which include cost effectiveness and compatibility of the working fluid with the components of the system. Water, which has a heat of vaporization of about 540 calories per gram at a boiling temperature of 100° C., is a suitable working fluid for many purposes. For certain low-temperature applications, ammonia or a Freon fluid might be preferable as the working fluid.

Figure 5:
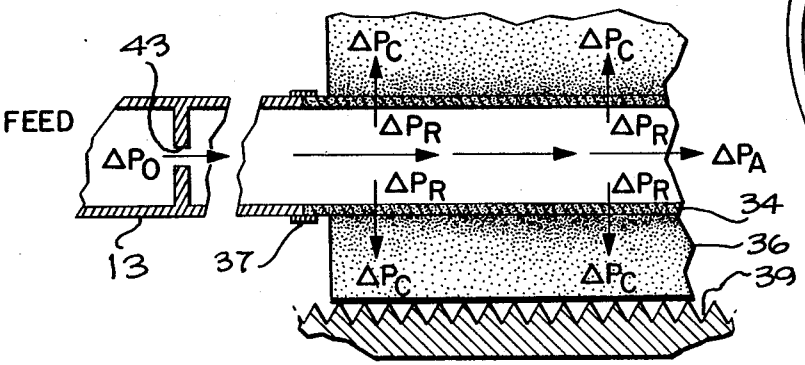
FIG. 5 is a longitudinal cross-sectional view of a fragmentary portion of the wick assembly disposed within the evaporator tube of FIG. 3.

As illustrated in FIG. 5, an orifice 43 is provided in each branch of the feed manifold 13 adjacent the junction thereof with the corresponding first tubule 34. The orifice 43 is dimensioned to provide a relatively high pressure drop $\Delta P_O$ for liquid-phase working fluid at the entrance of the tubule 34. The diameter of the first tubule 34 is dimensioned to provide a low resistance to longitudinal flow of liquid-phase working fluid within the tubule 34 along the cylindrical axis thereof. The material from which the first tubule 34 is made has a capillary pore size such that the capillary pressure drop $\Delta P_C$ for liquid-phase working fluid through the wall of the first tubule 34 is sufficiently low, so that the radial pressure drop $\Delta P_R$ for liquid-phase working fluid transversely across the first tubule 34 is much higher than the axial pressure drop $\Delta P_A$ for liquid-phase working fluid at the closed downstream end thereof. Consequently, liquid-phase working fluid seeps through the wall of the first tubule 34 into the surrounding high-permeability wick 36 at a substantially uniform rate along the entire length of the wick 36.

Liquid-phase working fluid then migrates by capillary action through the high-permeability wick 36 to the portion of the helically threaded capillary channel 39 on the interior surface of the evaporator tube 12 with which the high-permeability wick 36 is in contact. The rate of delivery of liquid-phase working fluid from the feed manifold 13 into the first tubule 34 is sufficient to assure that more liquid-phase working fluid enters the high-permeability wick 36 than is needed in the capillary channel 39 for absorbing the heat load by evaporation.

Each branch of the return manifold 14 is connected to a corresponding one of the second porous tubules 35 in a corresponding one of the evaporator tubes 12. Liquid-phase working fluid exceeding the quantity that can be retained by the saturated high-permeability wick 36 and the quantity needed to keep the capillary channel 39 wetted is sucked from the evaporator tube 12 into the return manifold 14 for passage via the return line 18 and the coadunate conduit 24 to the pump 26. Sufficient suction pressure is maintained in the second tubule 35 by the pump 26 to suck excess liquid-phase working fluid from the surrounding wick 36 at a substantially uniform rate along its length through the porous wall of the second tubule 35 into the interior thereof.

Figure 6:
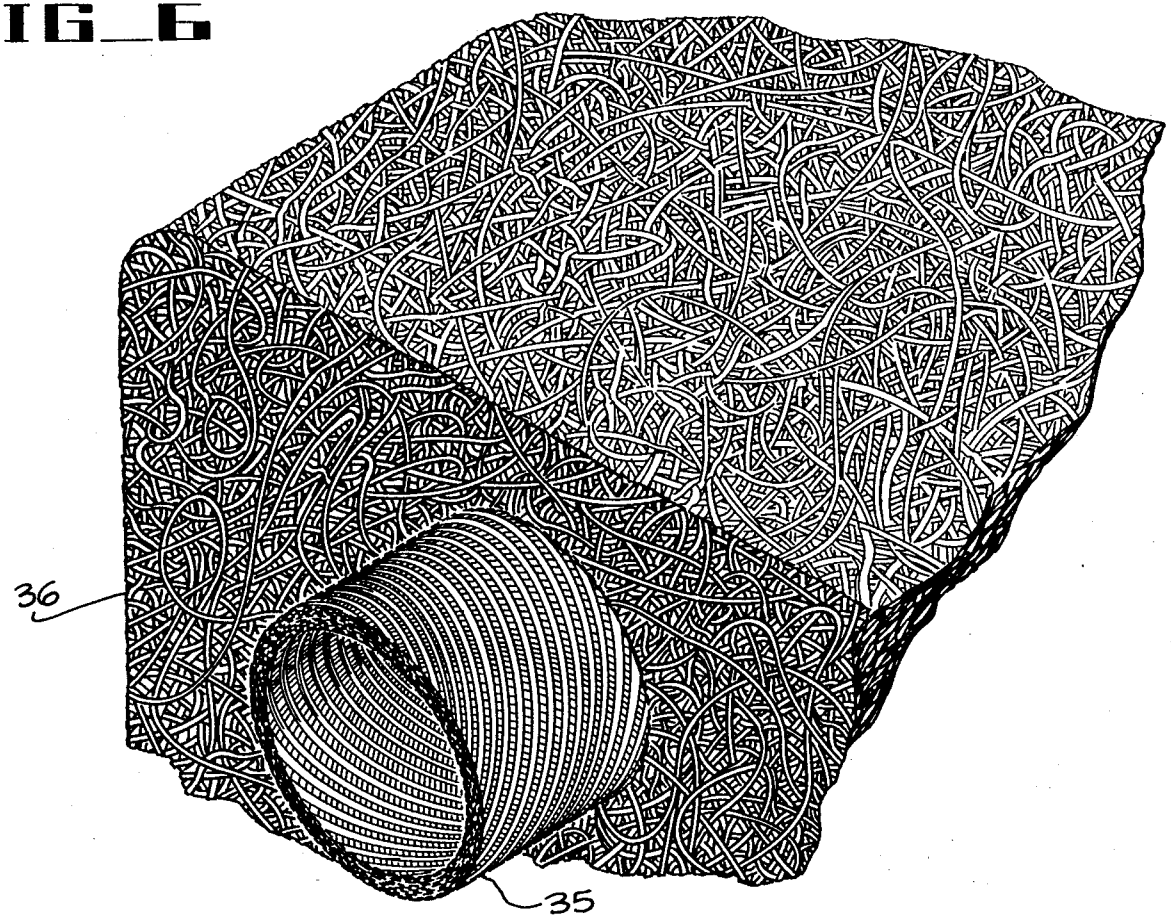
FIG. 6 is a perspective view of a fragmentary portion of the wick assembly disposed within the evaporator tube of FIG. 3.

In FIG. 6, a fragmentary portion of one end of the wick 36 surrounding the second tubule 35 is shown in which both the wick 36 and the second tubule 35 are made of sintered metal fibers. The wick 36 is made of randomly oriented fibers of relatively long length, which are compacted together and sintered to form a "sponge" of high permeability. The second tubule 35 is made of overlapping layers of a "fabric" consisting of relatively short metal fibers, which are substantially uniformly oriented so as to achieve a low permeability for liquid-phase heat transfer fluid.

Figure 7:
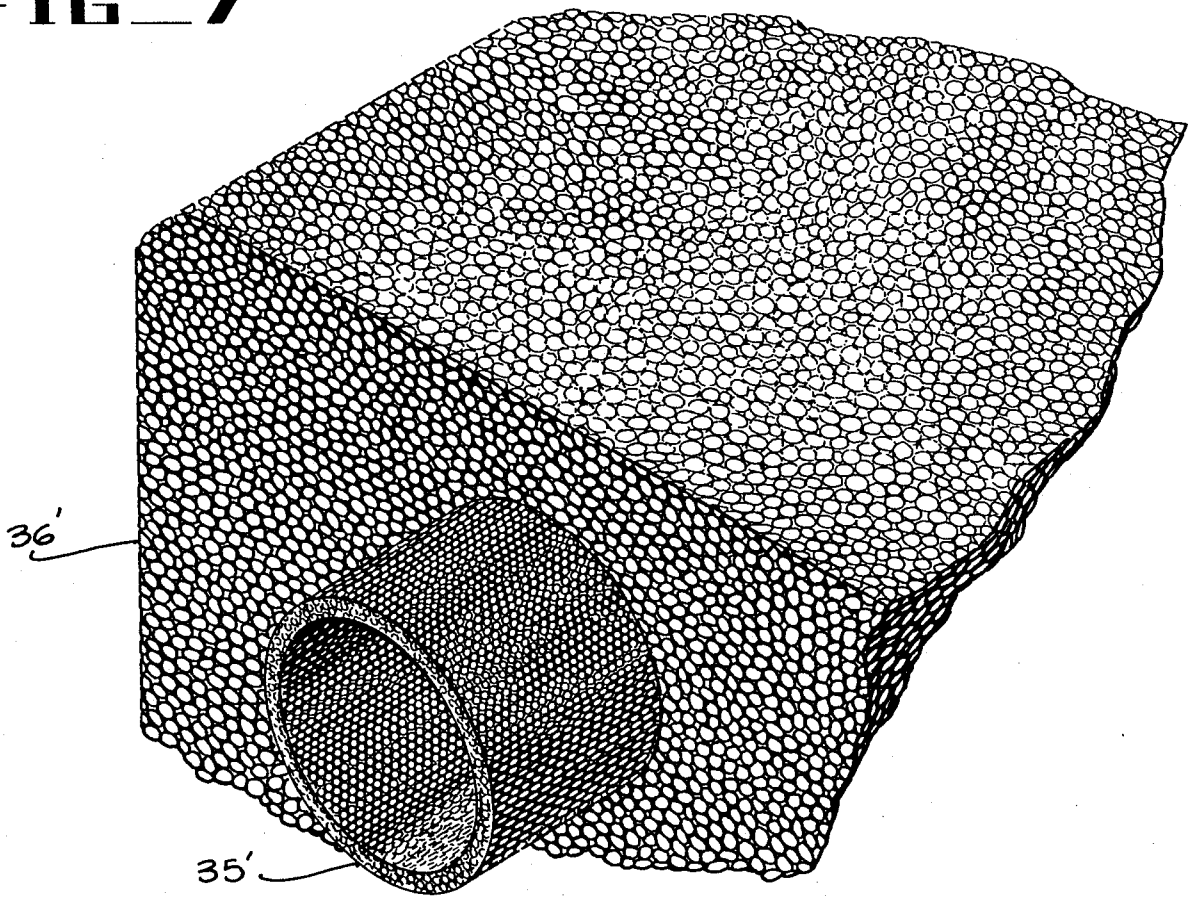
FIG. 7 is a perspective view of a fragmentary portion of an alternative embodiment of the wick assembly disposed within the evaporator tube of FIG. 3.

In FIG. 7, alternative materials are illustrated for the wick (indicated by reference number 36') and the second tubule (indicated by reference numeral 35'). The wick 36' is shown made of powdered metal particles of relatively large grain size, which are compacted together and sintered to form a "sponge" of high permeability. The second tubule 35' is made of overlapping layers of a "fabric" consisting of powdered metal particles of relatively small grain size, which when compacted together and sintered provide a low permeability for liquid-phase heat transfer fluid.

The wick assembly 33 of the present invention is fabricated by positioning the low-permeability first and second tubules 34 and 35 parallel to each other, at an appropriate separation with respect to each other, in a loosely packed collection of fibers or powdered particles from which the high-permeability wick 36 is formed, and then sintering the assembled components together. Alternatively, a mechanical joining (as by a press-fit and/or fasteners) to attach the first and second tubules 34 and 35 and the wick 36 together could be used.

Figure 8:
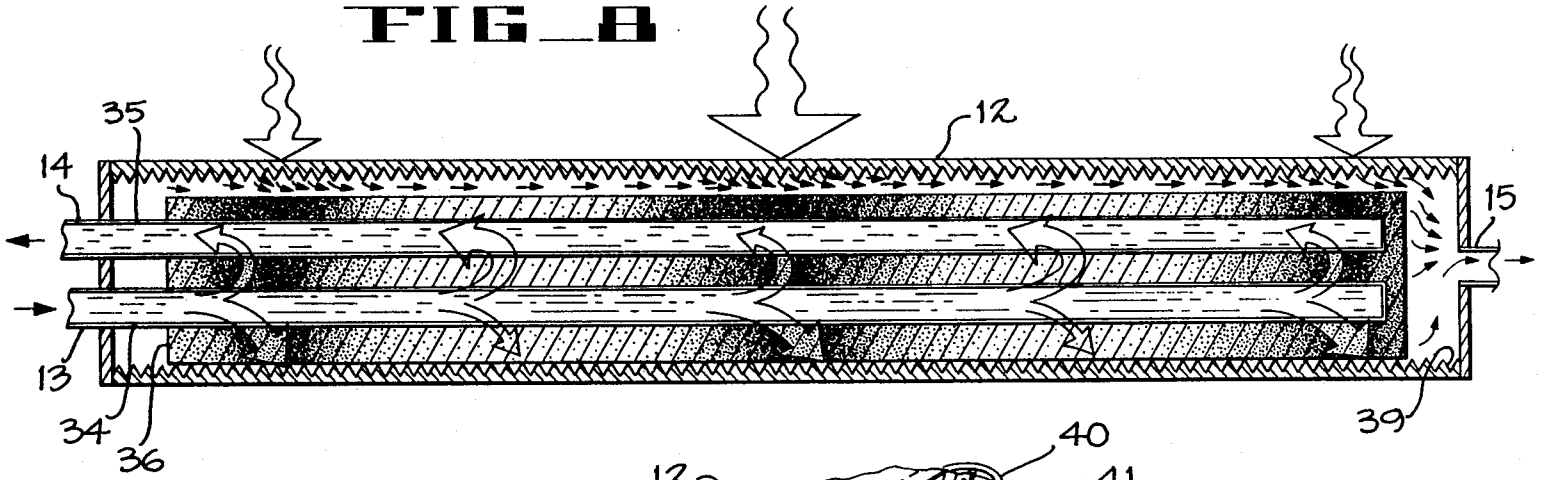
FIG. 8 is a schematic view in longitudinal cross section of an evaporator tube of the heat transfer system shown in FIG. 1.

Operation of the evaporator tube 12 as a heat exchanger is schematically illustrated in FIG. 8, wherein the exterior surface of the evaporator tube 12 is shown exposed to heat from a heat source. The amount of heat to which the evaporator tube 12 is exposed is not necessarily constant in time, nor is the amount of heat necessarily uniform along the length of the evaporator tube 12 at any given time. Liquid-phase working fluid introduced from the feed manifold 13 into the first porous tubule 34 seeps through the cylindrical wall thereof into the surrounding high-permeability wick 36. Liquid-phase working fluid saturates the wick 36, and then passes into the capillary channel 39 on the interior surface of the evaporator tube 12.

The rate of seepage of liquid-phase working fluid from the first tubule 34 into the wick 36 would be uniform along the length of the evaporator tube 12, if liquid-phase working fluid were to be evaporated from the capillary channel 39 at a uniform rate along the length of the evaporator tube 12. However, if evaporation of liquid-phase working fluid from the capillary channel 39 were to occur at a particular position along the length of the evaporator 12 at a greater rate than at adjacent positions, the wick 36 would have to supply a correspondingly greater amount of liquid-phase working fluid to the capillary channel 39 at that particular position in order to accommodate the increased heat load at that particular position. When the wick 36 supplies this correspondingly greater amount of liquid-phase working fluid to the capillary channel 39 at the particular position where evaporation takes place at the greater rate, a portion of the wick 36 in the vicinity of that particular position becomes correspondingly depleted of liquid-phase working fluid. The depleted portion of the wick 36 is then able to draw additional liquid-phase working fluid through the wall of the first tubule 34 at a correspondingly greater rate than are adjacent portions of the wick 36, so as to minimize concentration gradients for liquid-phase working fluid throughout the wick 36. In this way, the wick assembly 33 of the present invention continuously supplies liquid-phase working fluid to all portions of the heat-exchange surface of the evaporator tube 12 in the precise amount needed at any given time to meet changing requirements of a varying heat load.

Figure 9:
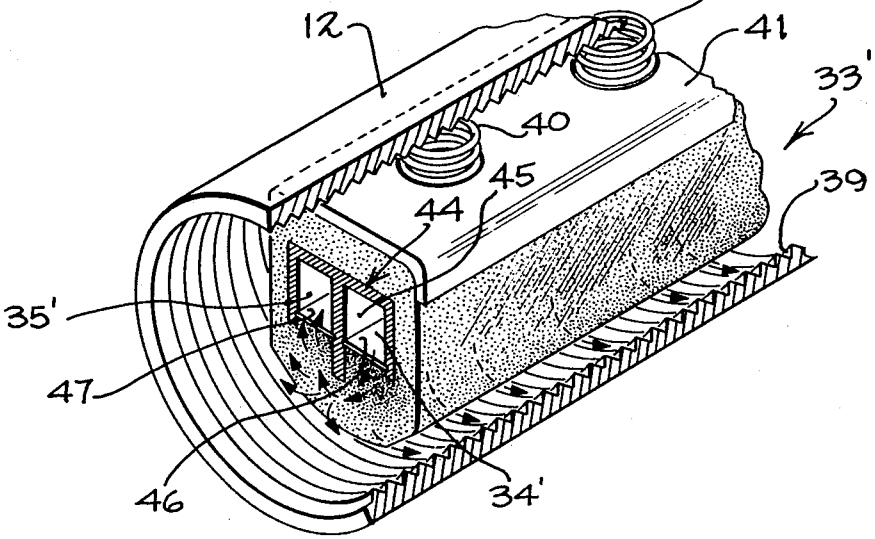
FIG. 9 is a cut-away perspective view of the evaporator tube of the present invention, but showing an alternative embodiment of the wick assembly positioned therein.

A wick assembly 33' according to an alternative embodiment of the present invention is illustrated in FIG. 9 in which the low-permeability first and second tubules 34 and 35 of the embodiment shown in FIGS. 3–8 are replaced by a dual open-sided tubular structure 44 of generally E-shaped transverse cross section, which defines two rectangular ducts 34' and 35' separated by a dividing wall 45. The dual open-sided tubular structure 44 is made of a material that is substantially non-permeable with respect to liquid-phase working fluid. In transverse cross-section, the dividing wall 45 corresponds to the horizontal middle bar of the letter "E", but (unlike the horizontal middle bar in the usual configuration of the letter "E") extends further from the vertical bar than the two horizontal end bars thereof. A strip 46 of low-permeability material extends longitudinally along one open side of the dual open-sided tubular structure 44 between the dividing wall 45 and a distal end of one wall that is parallel thereto (corresponding in transverse cross section to one of the horizontal end bars of the letter "E"). Likewise, a strip 47 of low-permeability material extends longitudinally along another open side of the dual open-sided tubular structure between the dividing wall 45 and a distal end of another wall that is parallel thereto (corresponding in transverse cross section to the other horizontal end bar of the letter "E").

Figure 4:
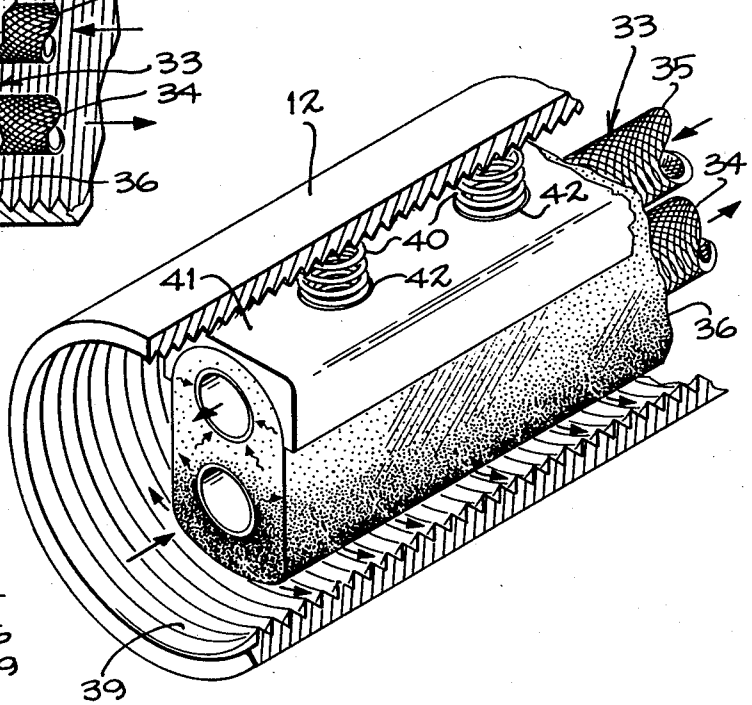
FIG. 4 is a cut-away perspective view of the evaporator tube of FIG. 3 showing a wick assembly positioned therein.

The low-permeability strip 46 together with the dual open-sided tubular structure 44 thereby defines the duct 34', and the low-permeability strip 47 together with the dual open-sided tubular structure 44 thereby defines the duct 35'. The dual open-sided tubular structure 44 and the low-permeability strips 46 and 47 are surrounded by and embedded in the high-permeability wick 36 in the manner described above with respect to the embodiment shown in FIGS. 3–8. The high-permeability wick 36 is pressed into contact with ridges defining the capillary channel 39 on the interior surface of the evaporator tube 12 by means of springs 40 in the same manner as illustrated in FIGS. 3 and 4.

In the embodiment shown in FIG. 9, the duct 34' corresponds to the first tubule 34 of the embodiment shown in FIGS. 3–8, and is connected at one end to a corresponding branch of the feed manifold 13. Similarly, the duct 35' corresponds to the second tubule 35 of the embodiment shown in FIGS. 3–8, and is connected at one end to a corresponding branch of the return manifold 14. The other end of each of the ducts 34' and 35' is closed by an end piece (not shown in the perspective of FIG. 9), which is substantially non-permeable with respect to liquid-phase working fluid. In operation, liquid-phase working fluid introduced at a relatively high pressure head into the duct 34' seeps out through the low-permeability strip 46 into the high-permeability wick 36. The extension of the non-permeable dividing wall 45 into the wick 36 beyond the positions of the low-permeability strips 46 and 7 prevents liquid-phase working fluid that seeps into the wick 36 from passing directly from the vicinity of the strip 46 to the strip 47, but instead causes liquid-phase working fluid to migrate through the wick 36 from the duct 34' to the vicinity of the capillary channel 39 on the interior surface of the evaporator tube 12. Capillary pumping of liquid-phase working fluid from the wick 36 into the capillary channel 39 predominates over migration of liquid-phase working fluid within the wick 36, until the capillary channel 39 becomes filled, whereupon any liquid-phase working fluid in excess of the amount needed to fill the capillary channel 39 migrates through the wick 36 to the low-permeability strip 47 and passes therethrough into the duct 35', which is connected to the return manifold 14.

Figure 10:
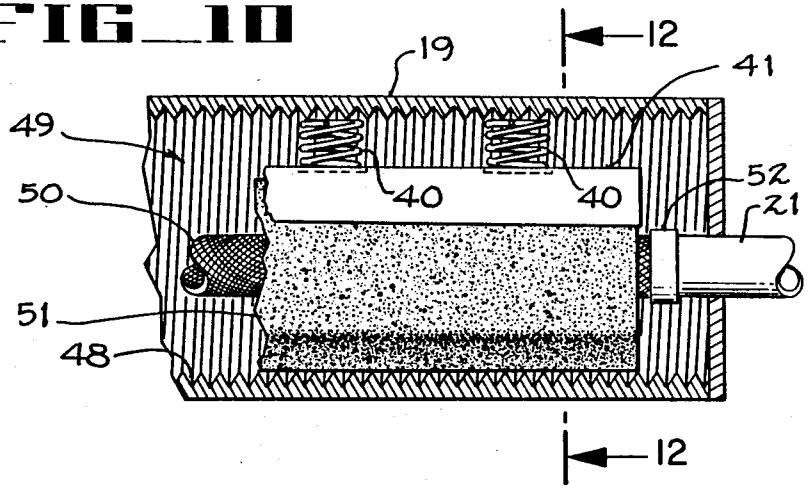
FIG. 10 is a cut-away view in longitudinal cross section of an end portion, as enclosed within arcuate line 10—10 of FIG. 1, of a condenser tube of the heat transfer system of FIG. 1.

Each condenser tube 19 of the preferred embodiment of the present invention is also preferably of the capillary type, and has a helically threaded capillary channel 48 of V-shaped transverse cross section formed on the interior surface thereof, as illustrated in FIG. 10. Positioned inside each of the condenser tubes 19 is a wick assembly 49, which comprises a single low-permeability tubule 50 embedded in a high-permeability wick 51. The tubule 50 is open at both ends. One end of the tubule 50 is connected at one end of the condenser tube 19 to a corresponding branch of the vapor entrance manifold 20 (as indicated in FIG. 2) by means of a coupling sleeve (not shown in the fragmentary view of FIG. 10). The other end of the tubule 50 is connected at the other end of the condenser tube 19 to a corresponding branch of the condensate exit manifold 21 by means of a coupling sleeve 52.

Figure 12:
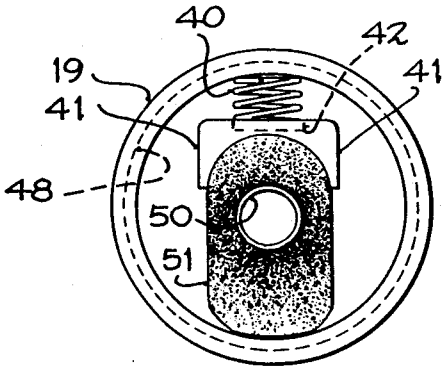
FIG. 12 is a transverse cross-sectional view of the condenser tube along line 12—12 of FIG. 10.
Figure 11:
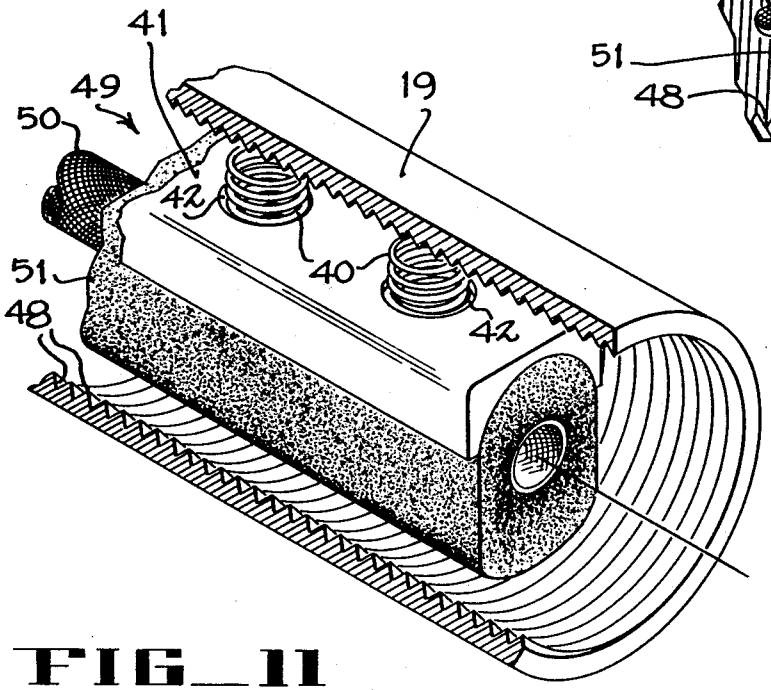
FIG. 11 is a cut-away perspective view of the condenser tube of FIG. 10 showing a wick assembly positioned therein.

The wick assembly 49 shown in FIG. 10 is seated upon (and pressed into contact with) ridges on the interior surface of the condenser tube 19 defining the threaded helical capillary channel 48. The technique for pressing the wick assembly 49 into contact with ridges defining the capillary channel 48 is preferably the same as the technique illustrated in FIGS. 2 and 3 for pressing the wick assembly 33 into contact with ridges defining the capillary channel 39 on the interior surface of the evaporator tube 12. Thus, as shown in FIG. 12, springs 40 under compression urge the yoke 41 (and the wick 51 in contact therewith) toward a portion of the ridges defining the capillary channel 48, so that a curved surface portion of the wick 51 is pressed into contact with ridges along substantially the entire length of the interior of the condenser tube 19. A perspective view indicating the curved surface of the wick 51 in contact with ridges defining the helical capillary channel 48 is shown in FIG. 11. A transverse cross-sectional view of the condenser tube 19 is shown in FIG. 12.

Figure 14:
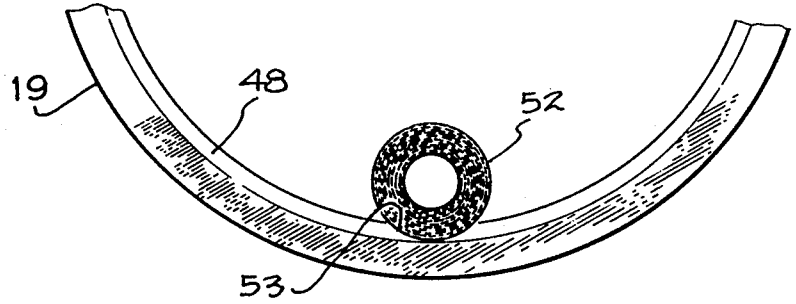
FIG. 14 is a transverse cross-sectional view of a portion of the condenser tube along line 14—14 of FIG. 13.
Figure 13:
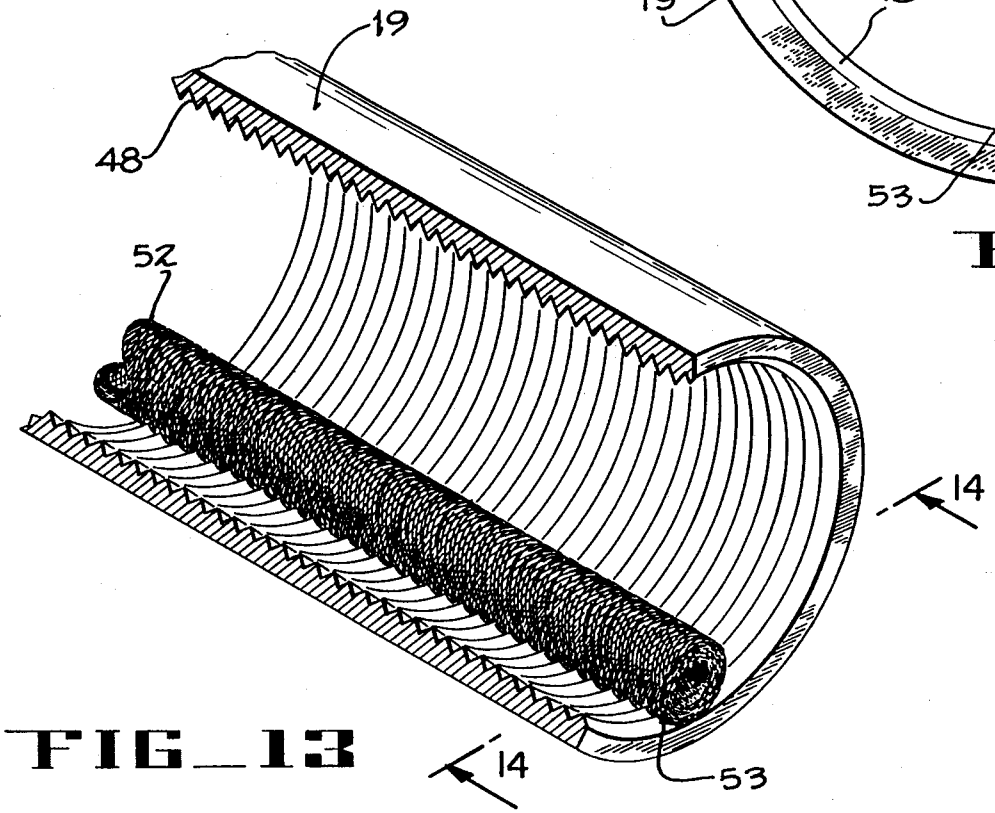
FIG. 13 is a cut-away perspective view of the condenser tube of FIG. 10, but showing an alternative embodiment of the wick assembly positioned therein.

In a particular application, the wick assembly 49 of FIGS. 10–12 could be replaced by a low-permeability cylindrical duct 52, as shown in FIG. 13, which performs the functions of both the tubule 50 and the wick 51 of the wick assembly 49. As indicated in FIGS. 13 and 14, the duct 52 is fixedly retained (as by welding) in a longitudinally extending groove 53 on the interior surface of the condenser tube 19. The diameter of the duct 52 is larger than the diameter of the groove 53 in order to ensure contact between the duct 52 and ridges defining the capillary channel 48. Vapor-phase working fluid entering the condenser tube 19 condenses to liquid phase on the interior surface thereof, and is transported by capillary action in the helical capillary channel 48 to the duct 52. Liquid-phase working fluid diffuses through the cylindrical wall of the duct 52 into the interior thereof, and is sucked therefrom into the condensate manifold 21 by the pump 26.

Figure 15:
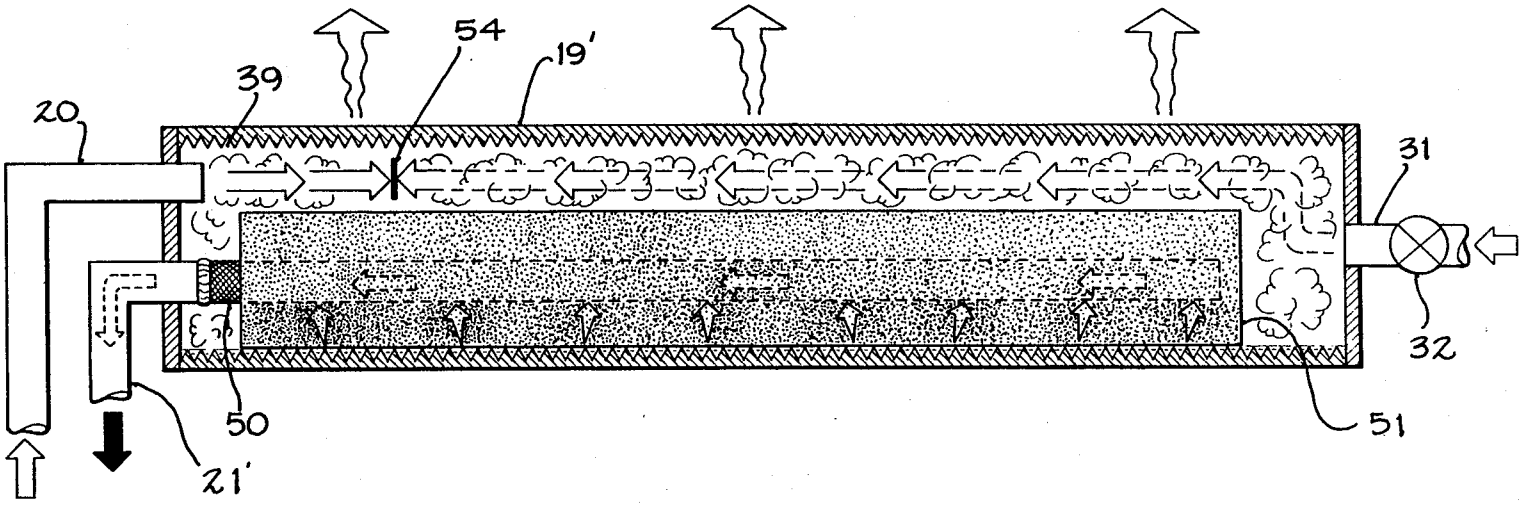
FIG. 15 is a schematic view in longitudinal cross section of a condenser tube of the alternative embodiment shown in FIG. 2.

For a system as illustrated in FIG. 2 in which a control gas is used to regulate the heat conductance of the condenser 11', the operation of each condenser tube 19' individually is illustrated schematically in FIG. 15. Vapor-phase working fluid entering into the interior of the condenser tube 19' at the first end thereof from the vapor entrance manifold 20 fills only that portion of the volume of the condenser 19' that is not occupied by control gas, which enters into the interior of the condenser tube 19' at the second end thereof from the control gas manifold 31. Control gas does not mix with vapor-phase working fluid, but instead forms a "wall" 54 inside the condenser tube 19' and thereby defines the effective volume within which heat exchange can take place. The longitudinal position of the "wall" 54 inside the condenser tube 19' can be adjusted by means of a two-way control valve 55, which controls the amount of control gas admitted from the control gas reservoir 32 into the condenser tube 19'.

Figure 16:
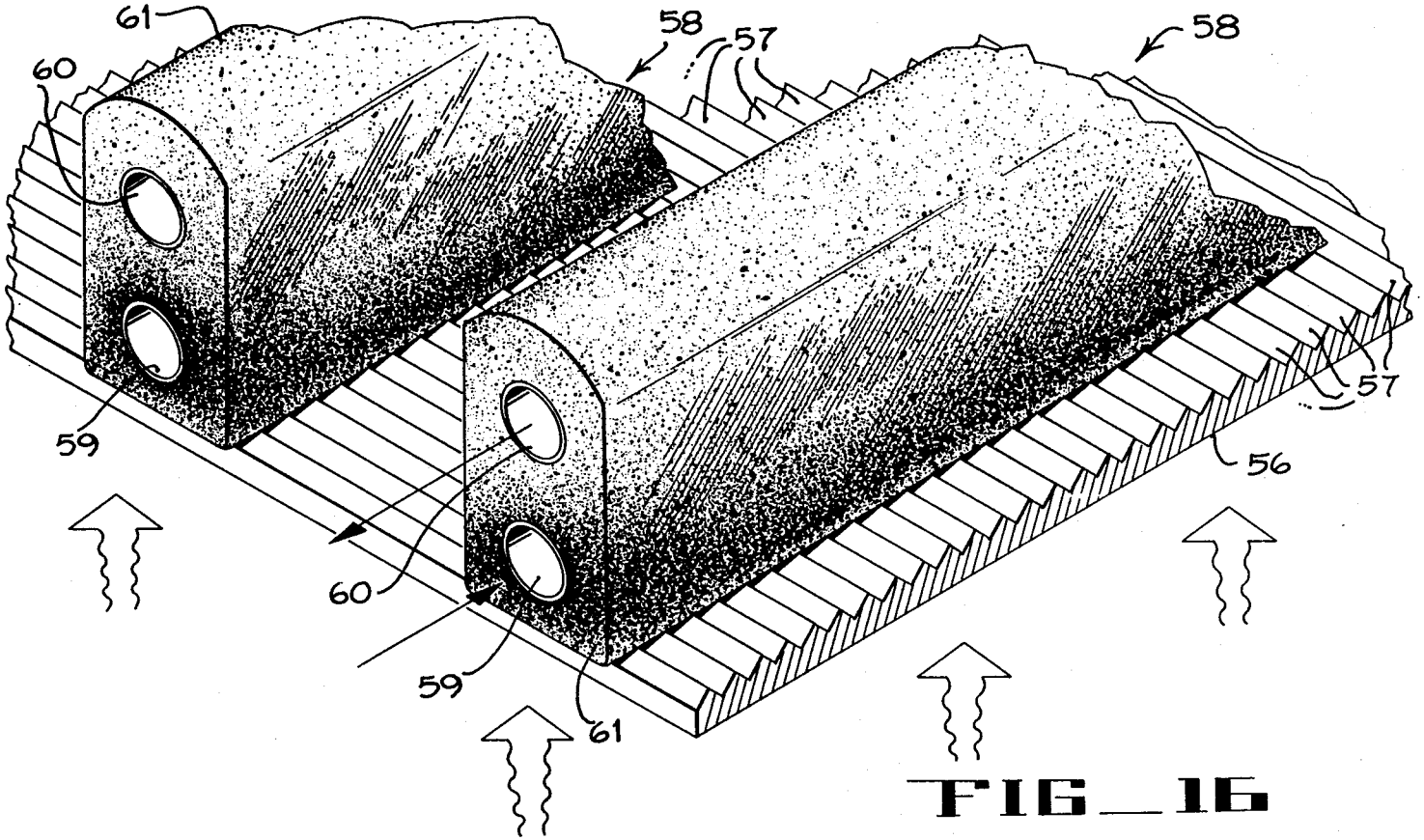
FIG. 16 is a cut-away perspective view of a fragmentary portion of an alternative embodiment of an evaporator for the heat transfer system shown in FIG. 1.

In an alternative embodiment of the invention, the evaporator 10 as shown in FIG. 1 could be replaced by an evaporation chamber with planar walls, preferably of rectangular configuration, as shown in fragmentary perspective view in FIG. 16. A flat wall 56 of an evaporation chamber of the embodiment illustrated in FIG. 16 has a plurality of linear capillary channels 57 formed on the interior surface thereof. The capillary channels 57 are parallel to each other, and are positioned immediately adjacent each other. Each capillary channel 57 has a V-shaped transverse cross section, whereby the level of liquid-phase working fluid in each capillary channel 57 decreases as the rate of evaporation of liquid-phase working fluid increases. A plurality of elongate wick assemblies 58 are positioned on the flat wall 56 transversely with respect to the capillary channels 57. Each wick assembly 58 comprises a first tubule 59 connected to a corresponding branch of the feed manifold 13, and a second tubule 60 connected to a corresponding branch of the return manifold 14. The first and second tubules 59 and 60, respectively, are of low-permeability with respect to liquid-phase working fluid, and are embedded in a high-permeability wick 61.

In operation, liquid-phase working fluid seeps out of the first tubules 59 of the various wick assemblies 58 inside the evaporation chamber of the embodiment shown in FIG. 16, and saturates the surrounding wicks 61. Sufficient liquid-phase working fluid is then drawn by capillary action from the saturated wicks 61 into the capillary channels 57. Excess liquid-phase working fluid beyond the amount needed to keep the capillary channels 57 wetted seeps through the walls of the second tubules 60 into the interiors thereof, and is sucked therefrom directly into the return manifold 14 by the suction pressure applied by the pump 26. No manifold corresponding to the vapor exit manifold 15 of FIG. 1 is needed with the evaporation chamber illustrated in FIG. 16, because vapor-phase working fluid generated by evaporation of liquid-phase working fluid from the capillary channels 57 is driven adiabatically through an aperture (not seen in FIG. 16) in one of the walls of the evaporation chamber into the vapor conduit 17.

A practical difficulty presents itself in attempting to insert the wick assembly 33 into the evaporator tube 12. One technique for doing so would involve inserting the yoke 41 (with the springs 40 positioned in the depressions 42 thereon) longitudinally through an open end of the evaporator tube 12 into the interior thereof, and then pushing the yoke 41 laterally against the bias of the springs 40 so as to provide room for insertion of the wick assembly 33. After the wick assembly 33 has been inserted to the proper position within the evaporator tube 12, the lateral force applied to the yoke 41 is removed so that the springs 40 (now compressed between the interior wall of the evaporator tube 12 and the flat surface of the yoke 41) urge the wick assembly 33 into contact with ridges defining the threaded helical capillary channel 39. However, in applications in which significant inertial forces are expected to be exerted upon the wick assembly 33 during operation of the system, it is expedient for the concave surface of the yoke 41 to be bonded securely to the contacting convex surface of the wick 36 before the wick assembly 33 is inserted into the evaporator tube 12, so that the wick assembly 33 cannot wobble with respect to the yoke 41.

Figure 17:
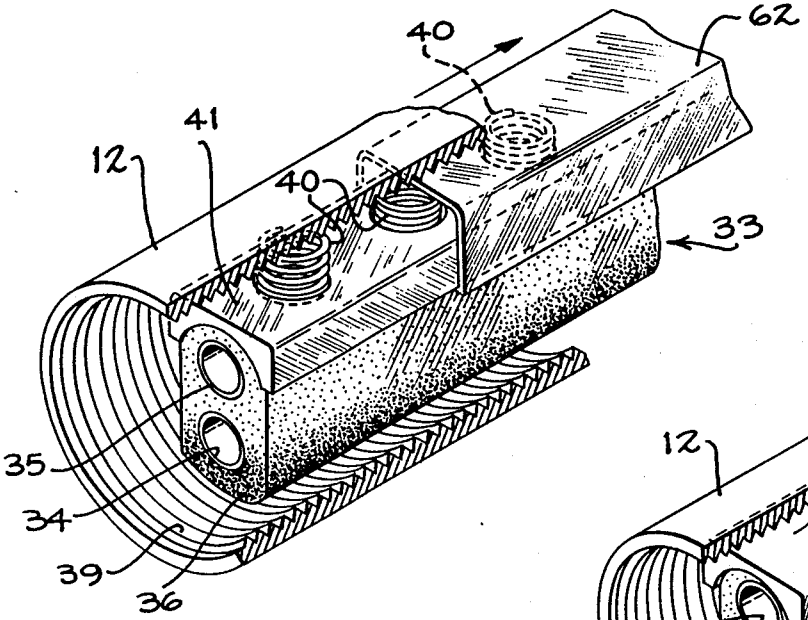
FIG. 17 is a cut-away perspective view of the evaporator tube as shown in FIG. 4 wherein a technique is illustrated for inserting the wick assembly into the evaporator tube.

A technique for inserting the wick assembly 33 with the yoke 41 bonded thereto (and with the springs 40 positioned in the corresponding depressions 42 on the flat surface of the yoke 41) longitudinally into the evaporator tube 12 is illustrated in FIG. 17. A slide 62 made of a smooth flexible plastic material such as polytetrafluoroethylene (marketed under the trademark Teflon) is placed over the springs 40 so as to compress the springs 40 between the slide 62 and the yoke 41. The slide 62 compresses the springs 40 sufficiently to enable the wick assembly 33 with the yoke 41 attached thereto, and with the springs 40 positioned in the depressions 42 on the flat surface of the yoke 41, to be slid longitudinally into the evaporator tube 12. After the wick assembly 33 is in place within the evaporator tube 12, the slide 62 is then slid (preferably manually) from the evaporator tube 12 at a slow rate of speed so that each spring 40 in succession pops up into contact with a corresponding portion of the channelled interior surface of the evaporator tube 12.

Figure 18:
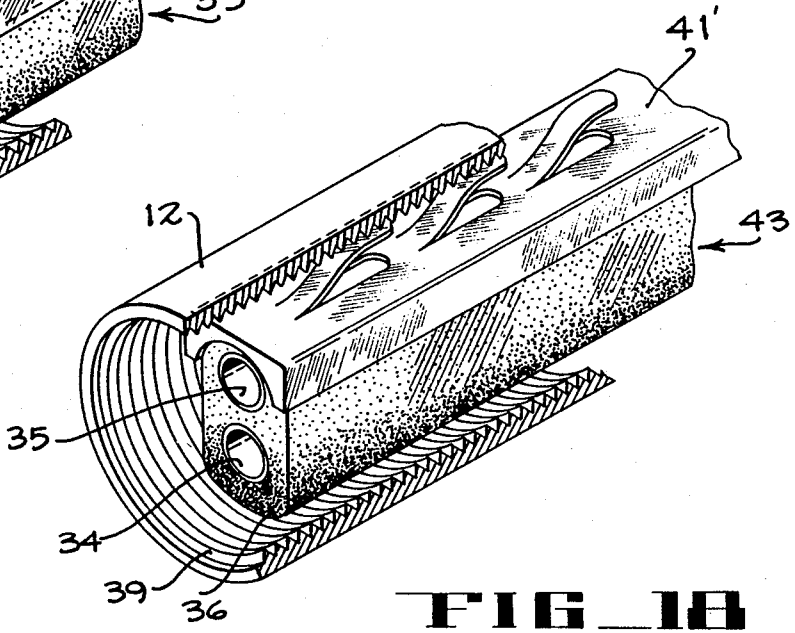
FIG. 18 is a cut-away perspective view of the evaporator tube of FIG. 4, but showing an alternative embodiment of a yoke for positioning the wick assembly within the evaporator tube.

In an alternative embodiment as illustrated in FIG. 18, the yoke 41 of FIGS. 3 and 4 could be replaced by a yoke 41' in which leaf-spring members 40' are used, which eliminate the need for the helical springs 40. The wick assembly 33 and the yoke 41' could be bonded together to form a combined structure, which can be inserted into the evaporator tube 12 by using a Teflon slide in the manner described above in connection with FIG. 17.

Particular embodiments of the present invention have been described and illustrated herein. Various modifications could be made to the embodiments shown herein in order to meet the requirements of specific applications. Accordingly, the present invention is not limited to the particular embodiments described and illustrated herein, but includes such modifications and alterations thereof as would be apparent to practitioners skilled in the art. The invention is therefore defined more generally by the following claims and their equivalents.

I claim:

1. A closed-loop heat transfer system comprising:

(a) an evaporator having a capillary channel on an interior heat-exchange surface thereof for distributing working fluid in liquid phase over said heat-exchange surface by capillary action;

(b) a condenser;

(c) a vapor conduit connecting said evaporator to said condenser, said vapor conduit enabling working fluid in vapor phase to pass from said evaporator into said condenser;

(d) a wick assembly disposed within said evaporator, said wick assembly enabling delivery of working fluid in liquid phase to said capillary channel on said interior heat-exchange surface of said evaporator for evaporation therefrom to vapor phase, said wick assembly also enabling withdrawal from said evaporator of working fluid in liquid phase in excess of an amount needed to keep said capillary channel continuously wetted within working fluid in liquid phase, said wick assembly comprising:

(i) a wick of relatively high permeability with respect to working fluid in liquid phase;

(ii) a dual open-sided tubular structure that is substantially nonpermeable with respect to working fluid in liquid phase; and (iii) a pair of elongate wall members that are of relatively low permeability with respect to working fluid in liquid phase; said dual tubular structure and said pair of wall members forming an assembly that defines a first duct and a second duct, with a dividing wall separating said first duct from said second duct; one end of said first duct being closed and another end of said first duct being open, the open end of said first duct communicating with said feed line; one end of said second duct being closed and another end of said second duct being open, the open end of said second duct communicating with said return line; a first one of said pair of wall members having a permeability such that liquid-phase working fluid delivered into said first duct from said feed line is able to seep therethrough from said first duct into said wick, a second one of said pair of wall members having a permeability such that liquid-phase working fluid in excess of said amount needed to keep said capillary channel continuously wetted with working fluid in liquid phase is able to seep therethrough from said wick into said second duct; said assembly formed by said dual tubular structure and pair of wall members being embedded in said wick, said dividing wall extending into said wick so as to prevent liquid-phase working fluid that seeps out of said first duct through said first one of said pair of wall members into said wick from passing directly to said second one of said pair of wall members for seepage into said second duct without first passing through a substantial portion of said wick; said wick assembly being disposed within said evaporator so that said wick is in contact with ridges defining a portion of said capillary channel on said interior heat-exchange surface of said evaporator, said substantial portion of said wick through which liquid-phase working fluid passes being adjacent said ridges, so that liquid-phase working fluid can be delivered from said substantial portion of said wick into said capillary channel by capillary action;

(e) a condensate line for withdrawal from said condenser of working fluid that has condensed from vapor phase to liquid phase in said condenser;

(f) a return line for withdrawal from said evaporator of working fluid in liquid phase in excess of said amount needed to keep said capillary channel continuously wetted with working fluid in liquid phase, said return line by-passing said condenser and merging with said condensate line;

(g) a pump, an inlet of said pump communicating with said condensate and return lines, said pump providing sufficient suction to withdraw from said condenser working fluid that has condensed to liquid phase therein, and to withdraw from said evaporator working fluid in liquid phase in excess of said amount needed to keep said capillary channel continuously wetted with working fluid in liquid phase; and (h) a feed line connecting an outlet of said pump to said evaporator, said feed line delivering working fluid in liquid phase from said pump to said evaporator.

2. A closed-loop heat transfer system comprising:

(a) an evaporator having a capillary channel on an interior heat-exchange surface thereof for distributing working fluid in liquid phase over said heat-exchange surface by capillary action;

(b) a condenser, said condenser comprising a tube having a helically threaded capillary channel on an interior heat-exchange surface thereof, said interior heat-exchange surface of said tube having an elongate groove thereon extending generally longitudinally with respect to said tube, said groove extending transversely with respect to said helically threaded capillary channel, said condenser further comprising a generally cylindrical elongate duct fixedly retained in said groove so that of an outer surface portion of said duct is in contact with ridges defining said helically threaded capillary channel, working fluid that condenses from vapor phase to liquid phase on said interior heat-exchange surface of said tube thereby being brought via said helically threaded capillary channel to said duct by capillary action, said duct having a permeability with respect to liquid-phase working fluid such that liquid-phase working fluid seeps into said duct from said capillary channel;

(c) a vapor conduit connecting said evaporator to said condenser, said vapor conduit enabling working fluid in vapor phase to pass from said evaporator into said condenser;

(d) a wick assembly disposed within said evaporator, said wick assembly enabling delivery of working fluid in liquid phase to said capillary channel on said interior heat-exchange surface of said evaporator for evaporation therefrom to vapor phase, said wick assembly also enabling withdrawal from said evaporator of working fluid in liquid phase in excess of an amount needed to keep said capillary channel continuously wetted with working fluid in liquid phase;

(e) a condensate line connected to said duct in said condenser for withdrawal from said condenser of working fluid that has condensed from vapor phase to liquid phase in said condenser;

(f) a return line for withdrawal from said evaporator of working fluid in liquid phase in excess of said amount needed to keep said capillary channel continuously wetted with working fluid in liquid phase, said return line by-passing said condenser and merging with said condensate line;

(g) a pump, an inlet of said pump communicating with said condensate and return lines, said pump providing sufficient suction to withdraw from said condenser working fluid that has condensed to liquid phase therein, and to withdraw from said evaporator working fluid in liquid phase in excess of said amount needed to keep said capillary channel continuously wetted with working fluid in liquid phase; and (h) a feed line connecting an outlet of said pump to said evaporator, said feed line delivering working fluid in liquid phase from said pump to said evaporator.

3. A wick assembly to be positioned inside an evaporator tube having a capillary channel on an interior surface thereof, said wick assembly comprising:

(a) a wick of relatively high permeability with respect to liquid-phase working fluid that is to be evaporated to vapor phase in said capillary channel;

(b) a dual open-sided tubular structure that is substantially nonpermeable with respect to working fluid in liquid phase; and (c) first and second elongate wall members that are of relatively low permeability with respect to working fluid in liquid phase; said dual open-sided tubular structure and said first and second elongate wall members forming an assembly that defines a first duct and a second duct, with a dividing wall separating said first duct from said second duct; one end of said first duct being closed and another end of said first duct being open, the open end of said first duct being connectable to means for delivering working fluid in liquid phase into said first duct; one end of said second duct being closed and another end of said second duct being open, the open end of said second duct being connectable to means for withdrawing working fluid in liquid phase from said second duct; said first elongate wall member having a permeability such that liquid-phase working fluid delivered into said first duct can seep therethrough from said first duct into said wick, said second elongate wall member having a permeability such that liquid-phase working fluid can seep therethrough from said wick into said second duct; said assembly formed by said dual open-sided tubular structure and said first and second elongate wall members being embedded in said wick, said dividing wall extending into said wick so as to prevent liquid-phase working fluid that seeps out of said first duct through said first elongate wall member into said wick from passing directly to said second elongate wall member for seepage therethrough into said second duct without first passing through a substantial portion of said wick; said wick assembly being configured for positioning inside said evaporator tube transversely with respect to said capillary channel so that said wick is in contact with ridges defining a portion of said capillary channel, said substantial portion of said wick through which liquid-phase working fluid passes being adjacent said ridges, so that liquid-phase working fluid can pass by capillary action from said wick into said capillary channel.

4. A closed-loop heat transfer system comprising:

(a) an evaporator having a capillary channel on an interior heat-exchange surface thereof for distributing working fluid in liquid phase over said heat-exchange surface by capillary action;

(b) a condenser having a capillary channel on an interior heat-exchange surface thereof;

(c) a vapor conduit connecting said evaporator to said condenser, said vapor conduit enabling working fluid in vapor phase to pass from said evaporator into said condenser;

(d) a wick assembly disposed within said evaporator, said wick assembly in said evaporator enabling delivery of working fluid in liquid phase to said capillary channel on said interior heat-exchange surface of said evaporator for evaporation therefrom to vapor phase, said wick assembly in said evaporator also enabling withdrawal from said evaporator of working fluid in liquid phase in excess of an amount needed to keep said capillary channel continuously wetted with working fluid in liquid phase;

(e) a wick assembly disposed within said condenser, said wick assembly in said condenser comprising an elongate porous structure extending through said condenser in contact with ridges defining said capillary channel on said interior heat-exchange surface of said condenser, working fluid that condenses from vapor phase to liquid phase on said interior heat-exchange surface of said condenser thereby being brought via said capillary channel to said porous structure by capillary action, said porous structure having a permeability with respect to liquid-phase working fluid such that liquid-phase working fluid seeps into said porous structure from said capillary channel;

(f) a condensate line connected to said porous structure of said wick assembly disposed within said condenser for withdrawal from said condenser of working fluid that has condensed from vapor phase to liquid-phase in said condenser;

(g) a return line for withdrawal from said evaporator of working fluid in liquid phase in excess of said amount needed to keep said capillary channel continuously wetted with working fluid in liquid phase, said return line by-passing said condenser and merging with said condensate line;

(h) a pump, an inlet of said pump communicating with said merging condensate and return lines, said pump providing sufficient suction to withdraw from said condenser working fluid that has condensed to liquid phase therein, and to withdraw from said evaporator working fluid in liquid phase in excess of said amount needed to keep said capillary channel continuously wetted with working fluid in liquid phase; and (i) a feed line connecting an outlet of said pump to said evaporator, said feed line delivering working fluid in liquid phase from said pump to said evaporator.

5. The closed-loop heat transfer system of claim 4 wherein said porous structure of said wick assembly disposed within said condenser is made of material having a pore size that is sufficiently small to prevent any significant amount of working fluid in vapor phase from being drawn by said pump into said condensate line over a range of suction pressures, said range of suction pressures extending from a minimum pressure at which said excess working fluid in liquid phase seeps into said porous structure to a maximum pressure at which bubbles of working fluid in vapor phase start to be drawn into said porous structure.

* * * * *